US006059573A

United States Patent [19]

Patel

[11] Patent Number: 6,059,573

[45] Date of Patent: May 9, 2000

[54] MORTAR TRAINING DEVICE WITH FUNCTIONAL SIMULATED PROPELLING CHARGES

[75] Inventor: Ramesh Patel, Alpharetta, Ga.

[73] Assignee: FATS, Inc., Suwanee, Ga.

[21] Appl. No.: 09/045,761

[22] Filed: Mar. 20, 1998

[51] Int. Cl.[7] ..... F41A 33/00; F41G 3/26

[52] U.S. Cl. ..... 434/16; 434/18; 434/19; 434/24

[58] Field of Search ..... 434/11, 12, 16–24; 102/444, 445, 498

[56] References Cited

U.S. PATENT DOCUMENTS

| | | | |
|---|---|---|---|
| 2,308,798 | 1/1943 | Peiker | 124/75 |
| 2,322,212 | 6/1943 | Allen | 434/24 |
| 4,326,847 | 4/1982 | Roe | 434/12 |
| 4,427,386 | 1/1984 | Fields | 439/19 |
| 4,561,848 | 12/1985 | Freeny, Jr. et al. | 434/18 |
| 4,711,180 | 12/1987 | Smolnik | 102/445 |
| 4,824,374 | 4/1989 | Hendry et al. | 434/22 |
| 4,877,403 | 10/1989 | Jurgens | 434/24 |
| 5,228,855 | 7/1993 | Frost | 434/12 |
| 5,688,124 | 11/1997 | Salzeder | 434/11 |

*Primary Examiner*—Robert A. Hafer
*Assistant Examiner*—John Edmund Rovnak
*Attorney, Agent, or Firm*—Herbert M. Hanegan; J. Rodgers Lunsford, III; Charles L. Warner, II

[57] ABSTRACT

A full-size mortar training device which includes full-size, simulated, propelling charges is disclosed. Both 81 mm and 60 mm mortar training devices are disclosed. The device provides realistic training on virtually all aspects of mortar firing. The device allows training in target sight acquisition and mortar positioning (elevation and azimuth), sight reacquisition due to recoil, dropping a round, adjusting the number of charges, as required, to achieve a desired zone of firing distance, adjusting the projectile fuse setting to control time of explosion, provides realistic firing sound, and allows trainees to follow procedures similar to those used with standard mortar service ammunition. The device includes a cartridge projectile which contacts a pad within and at the lowermost point of the mortar barrel which is not propelled from the mortar barrel and which provides data to a computer system to determine if an area or object would have been impacted by the mortar projectile, provides analysis of trainee firing errors and provides for the simulation to be replayed for trainee instructional and other purposes. The 60 mm device includes a hand-held firing option and the 81 mm device includes a blast attenuator device to further enhance the realism of the simulation.

7 Claims, 13 Drawing Sheets

MORTAR TRAINING DEVICE WITH FUNCTIONAL SIMULATED PROPELLING CHARGES

BACKGROUND OF THE INVENTION

This invention relates to a class of mortar training devices which are intended to provide realistic mortar firing training at low cost. In particular, the invention relates to a method of realistically simulating a standard propelling charge system including appearance, handling, operating procedures, and functions in a mortar training device.

An effective training system permits or requires the trainee to perform a complete sequence of procedures in the same way as with standard service ammunition, with as much similarity in appearance, handling, feel and functionality of the material as is feasible, and with safety and low cost.

A major shortcoming of existing training devices is their inability to achieve the desired realism in handling and adjustment of propelling charges for zoning. Examples of this deficiency may be found with training devices in current use for the 81 mm mortar system, viz., the M880 Training Cartridge, and the M1 Sabot with 22 mm Sub-caliber Practice Cartridges M744, M745, M746 and M747.

The M880 Training Cartridge consists of a kit of expendable component assemblies and a full-size flight projectile of limited reusability. The kit contains a fuse with spotting charge, an ignition cartridge, and small plastic plugs. The components of the kit are pre-assembled in the field to the projectile. The small plugs are inserted into the inlet end of gas exhaust ports, the latter located in the main body of the flight projectile.

The trainee selects a desired charge zone by removing an appropriate number of plugs from the projectile prior to drop firing. The unplugged gas ports exhaust a portion of the propelling gases through the projectile body to debilitate energy delivered to the projectile.

The act of removing the plugs and checking the number of plugs remaining in place prior to drop firing purports to correspond with service procedures for removal and checking of propelling charges. However, the plug arrangement fails in simulating size, configuration, locale, and method of removal relative to that of standard service propelling charges. Accordingly, the M880 Training Cartridge is deemed to lack the desired realism in this aspect of training.

The M1 Sabot system with its sub-caliber cartridges is a training device which employs a sub-caliber flight projectile housed within a sabot projectile. The system fires the sub-caliber projectile to a desired distance, while the sabot projectile is ejected a few yards from the mortar weapon. The sub-caliber projectile contains a fuse and spotting charge to permit sighting of impact.

The M1 system has no means for adjusting the charge to achieve the desired range distance zoning. Instead, the trainee selects a specific sabot projectile which is pre-fitted with a sub-caliber cartridge having the appropriate charge level. The trainee is able to discriminate between the charge level of each projectile by inspection of identifying notches at the exposed base of each cartridge.

Other known large-caliber training or practice projectiles with a simulator system endeavor to imitate actual projectiles, in substantially the same manner as regular equipment, so that it is possible to emulate actual firing conditions.

In order to be able to fire off this type practice projectile over variable ranges and in order to be able to load the practice or training cartridge rapidly in a regular weapon for training purposes, while simulating actual firing conditions, the head portion of such training projectile has an internal gas passage with openings for the entry of the propellant gases. Further bores are provided for discharge of the propellant gases whereby, when the training projectile is fired, the effect produced is that the resulting propellant gases are passed through the inner openings forwardly along the internal passage and out of the discharge openings again. The entry openings can be closed off by plugs or stoppers whereby different cross-sectional areas are defined as between the entry openings. By opening or closing such entry openings, it is possible to vary the firing range of such a practice cartridge. This training projectile is not suitable for firing simulation in a very small area or in assembly shops.

The present invention relates generally to remote actuation systems and more particularly, but not by way of limitation, to a system for designating an affected zone within a target area, which system specifically includes a method and an apparatus for simulating the firing of selected mortar ammunition within a selected actual geographical target area and evaluating the effectiveness of the firing.

In the military there is the need to employ lethal weapons in a non-lethal manner so that equipment and personnel can be trained in realistic battle environments without the risk of being damaged or injured. This ability to realistically train is one of the highest priority missions of the United States armed forces so that personnel can be realistically trained to survive in battle rather than to be killed, which latter result is believed by some to be, in many cases, the result of training exercises in which personnel are not immediately and individually advised of the effect of some action in the staged battle.

There presently exists a laser-based training system, referred to as the multiple integrated laser engagement system (MILES), wherein direct, line-of-sight fire between soldiers or between tanks (generally referred to as point targets) can be replicated or simulated. With this prior art system, a laser apparatus on each weapon is activated to produce a laser beam directed at the point target when the trigger on the weapon is pulled. If the laser beam strikes a sensor on the target, the target's weapon is disabled by a disabling unit carried by the target, thereby immediately indicating that the target has been hit. This has proved to be a useful system; however, its usefulness is limited to direct fire, visual line-of-sight actions so that the laser can be used without interference. Therefore, there is the need for a system which can replicate or simulate the real-time effect of indirect fire, such as mortar fire, which covers an area target on the ground for the purpose of affecting any point targets which happen to be within the target area, thereby enabling combined arms battles to be staged for realistically training personnel.

This need for some type of indirect fire simulating system has long been recognized; however, there has not previously been any suitable solution which has been favorably received by the potential users. One earlier proposal suggested the use of satellites for receiving signals from the remote location where the indirect firing weapon is located and then for sending signals to the target area. Such a proposal is technologically sophisticated; however, it is too expensive and requires a sensing device too heavy for personnel to carry and still be able to properly maneuver in a realistic training environment.

Another proposal relies upon relatively simple technology which is inexpensive, but which provides an unrealistic effect. This proposal provides that a foam rubber bullet be launched by a mortar-type device. The bullet is to be detonated in the air to send an acoustic signal which can actuate the presently used MILES sensors carried by the personnel and equipment within the target area.

Therefore, there is a need for a system which simulates the effectiveness of multiple types of weaponry, particularly indirect munitions such as mortar fire, to provide a combined arms simulation technique useful in training military units in various battle environments. To reduce costs the system should require minimum personnel and training to operate. Use of such a system should be available for all sizes of military units, such as from the platoon through corps; and use by such units should not interfere with their normal operation (e.g., use of the system should not alter the realism with which a battle is simulated). Such a system should also be operational in various types of environments where the firing to be replicated can occur (e.g., rain, fog, mountains, forests).

While existing systems provide a means for selecting a charge zone, none provide the desired realism in simulating service conditions with respect to appearance and handling of propelling charges, viz., size, configuration and location of the charges, method of attachment and firing of the projectile, sight acquisition and re-acquisition, after recoil of a target, types of cartridges and means for visual or nonvisual inspection of firing results.

SUMMARY AND OBJECTS OF THE INVENTION

An object of the invention is to provide a simulation training device for indirect mortar projectiles which simulates firing, which permits handling of a mortar in a hall or in a restricted training area and which retains all of the movements involved with firing a live projectile. More specifically, the present invention simulates, and thus provides training in, virtually all aspects of mortar firing including sight acquisition of a target, re-acquisition of the sight which is required because of mortar recoil from firing, dropping a real round of ammunition into the mortar, selecting from various types of mortar cartridge rounds (e.g. illumination, smoke, high explosive), selecting cartridge fuse settings to determine time of cartridge detonation, selecting number of charges to achieve desired projectile distance, selecting mortar elevation and azimuth positions for firing accuracy. The present invention provides realistic simulation of the size, feel, maneuverability and configuration of the mortar, cartridge, and charge components, use of safety pin in controlling detonation, determining if the cartridge fires or is a dud based on realistic firing sound, the speed with which the mortar can be loaded, unloaded, and fired, as well as the sound of firing and the feel (and offset) of recoil.

According to the invention, an ejector device for simulating firing of mortar projectiles is provided comprising a projectile body with a barrel chamber into which there is disposed a propellant charge. The barrel is defined in the form of a standard mortar bore provided at the closed end with an electronic contact pad.

For known large-caliber training or practice projectiles for mortars in accordance with the state of the art, there has until now been no possibility of simulating loading a mortar in an assembly shop or hall or in an only restrictedly available space. Even special charges for training or practice projectiles require a relatively large, safeguarded space. Due to the relatively large initial combustion chamber and the large degree of gas slippage through the air gap between the projectile and the firing projector, it is often difficult to operate with a suitable charge which reliably throws the large-caliber training or practice projectile only a few meters away. It is here that the present invention now follows a completely different path by realistically simulating the firing of the projectile and where it would hit without the use of live ammunition and without actually ejecting the projectile.

A principal object of this invention is to provide an effective and inexpensive device suited for mortar gunnery training which addresses the need for adequately simulating service procedures in the handling and manipulation of propelling charges in a small or otherwise restricted space.

These objects of the invention will become apparent to persons skilled in the arts and techniques of mortar gunnery or design of mortar ammunition by reference to the following description when taken with the accompanying drawings which illustrate the invention principle.

Figure 1:
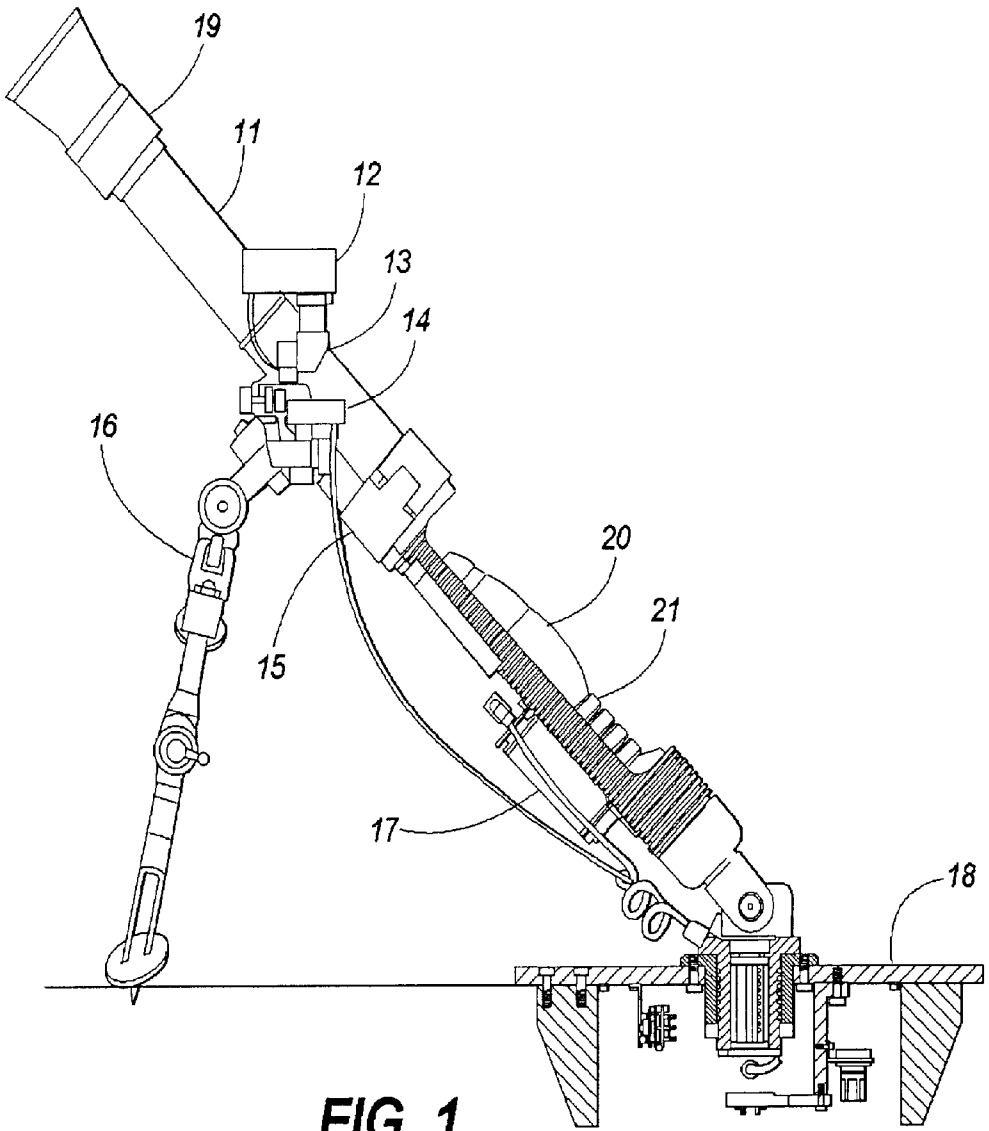
FIG. 1 is a side elevation view of an 81 mm full-size mortar training device according to one embodiment of the present invention illustrating the use of a full-size simulated cartridge assembly attached to a base assembly having portions broken away to reveal further details.

Infantry mortars such as the 60 mm (M224) and 81 mm (M252) are indirect fire gunnery. With such indirect fire apparatus, mortarmen are often unable to see the target at which they are firing. To compensate for this short-coming the gunnery team employs the concept of indirect fire to deliver effective fire support. Because the mortar gunner can neither see nor determine the range to his target, he must determine the direction to it by establishing some point other than the target on which to sight. Normally, this aiming point is an aiming post, but it could be any well-defined object such as a tree trunk or the comer of a building. It is also necessary to know the range to the target so that he can set the proper elevation on the mortar. Information on the target such as the range to the target and the target coordinates are provided by the forward observer. The forward observer is the eyes of the gunnery team and provides data on the target to the company commander who converts the data into firing instructions which are then supplied to the gunner for laying the direction of fire for the mortar. The gunner first determines the initial data for laying the mortar using methods known in the art. The mortar gunner first establishes a constant point of aim in the general direction of the target. This constant point of aim will normally be an aiming post. Once the point of aim has been established, the gunner can point the mortar generally at the target. By placing his sight parallel to the mortar barrel, the gunner can align the barrel in the direction of fire by looking through the sight and aligning the line of sight (LOS) on the point of aim. The gunner is then prepared to receive a "Fire" command. Deflection is the angle between the LOS and the line of fire (LOF). On a 60 mm mortar, the sight is normally set at a deflection of 3200 mils. When the sight is set at a reading of 3200, the LOS is parallel with the long axis of the mortar barrel. The mortar-sight relationship is left, adds; right, subtracts; that is, to move the round left, increase the sight reading; and to move the round right, decrease the sight reading. The forward observer provides range and angular information to allow the gunner to set the proper elevation and adjust the sight reading from the deflection point. Once the sight reading is adjusted, the mortar is then moved so that the sight is then once again aimed at the aiming post. In this way, the line of fire is now focused on the target. The present invention provides training in all of these required procedures, with the added benefit that the instructor can view the gunner's sight in real time and see the mortar settings made by the gunner which are input into the computer system and can later replay the entire exercise with the mortar user for critique.

The infantry mortar is a muzzle loaded, high angle, smooth bore, indirect fire weapon. In most weapons, from small caliber pistols up to and including the largest automatic cannon, the projectile is loaded in the rear or base of the barrel by means of a bolt or breech. Mortars, having no breech or bolt, are loaded from the muzzle of the barrel. The mortar is a high angle weapon primarily because of the high, arching trajectory of its projectile.

In a standard mortar, propelling charges for service use are typically horseshoe-shaped and stacked in a group of four charges about the boom of a fin-stabilized mortar projectile. The charges are assembled to the boom through the open end of the horseshoe and snapped in place. Each charge may be removed individually. Removal of one or more charges prior to drop-firing the projectile reduces the velocity of the projectile and thereby foreshortens flight time and distance of impact. Each velocity level is identified as a charge zone number, according to the number of charges employed, including Charge 0 where all charges are absent and only the ignition cartridge propels the projectile out of the weapon.

There are many types of mortar ammunition, all are classified as Semifixed Complete. Semifixed ammunition is characterized by an accessible propelling charge which permits the charge to be varied, giving a greater flexibility in the type of trajectory. Complete ammunition is one that has all the necessary components to fire. Once a round consists of all its component parts it is referred to as a cartridge. Regardless of type, a mortar cartridge consists of 5 basic components: the shell, the filler, the fin assembly, the fuse, and the propelling charge. The shell acts as a container for the filler. The filler is the material contained inside the body. The fin assembly stabilizes the cartridge in flight. The fuse activates the filler in the shell upon impact. The propellant charge propels the mortar cartridge from the mortar barrel toward the target.

A mortar is fired by inserting a cartridge into the muzzle. When released, gravity and the angle of the barrel force the cartridge to slide to the base of the barrel. The primer is subsequently denoted by the firing pin, which ignites the ignition cartridge. This, in turn, ignites the charge increments. The expanding gases create pressure that is trapped in the barrel by the shell of the cartridge. As this pressure builds and the gases expand even further, the cartridge is pushed from the barrel. The greater the number of charge increments attached to the fin assembly, the greater the pressure of expanding gases. This pressure increases the muzzle velocity of the cartridge and results in greater range. The system of the present invention "senses" how many charges have been placed on a fin assembly and calculates and simulates how far the cartridge would fly if actually fired. Thus, the user is able to learn, through simulation, how many charges to use to achieve a desired hit.

The elevation of the barrel affects the ease with which the cartridge falls to the base. The closer the elevation of the barrel is to being perpendicular to the ground, the easier it is for the cartridge to reach the base. Conversely, the more the barrel approaches being parallel to the ground, the harder it is for the cartridge to reach the base. Thus, one can see that for proper functioning the mortar barrel requires a high angle of elevation. This and the resulting high arc of the trajectory gives the mortar its classification as a "high angle" weapon.

The barrel assembly of a standard mortar has a removable breach plug and firing pin. The muzzle end has a short tapered lead-in for the cartridge and a BAD (blast attenuator device) and the breach end is finned for better cooling. The 60 mm barrel has a handle for hand held firing and does not have a BAD. These same features are present in the mortar training device of the present invention.

The mortar mount is an offset (straight for 60 mm) bipod consisting of a barrel clamp assembly which secures the bipod to the barrel. In a standard mortar, two mortar mounting buffers which reduce the shock of firing on other components, a traversing gear assembly for adjusting the mortar in azimuth, an incross (bubble) leveling mechanism for correcting weapon cant, and elevating mechanism to raise and lower the cannon, and two leg assemblies to provide a stable base are also included. In the device of the present invention, the buffers are replaced with means that simulate mortar recoil on firing.

The baseplate is a one piece solid construction baseplate. During firing, the barrel is secured to the baseplate by inserting the spherical projection into the socket and rotating it 90 degrees. The open end of the socket should always be pointing in the direction of fire.

The sight unit consists of a 1.5 power elbow telescope with tritium-illuminated simple cross reticle and a telescope mount with the tritium-backlighted level vial, indices, and translucent plastic scales. The telescope mount includes a 6400-mil azimuth mechanism with one set of coarse and fine deflection scales. A similar mechanism is provided for elevation but is limited in travel to readings from 800 mils to 1600 mils on coarse and fine elevation scales.

DETAILED DESCRIPTION OF THE PREFERRED EMBODIMENT

Referring to FIG. 1, the 81 mm mortar training device includes barrel assembly 11, beam splitter 12, side unit 13, bubble level sensor 14, recoil assembly 15, bipod assembly 16, air cannon assembly 17, base assembly 18, blast attenuator device (BAD) 19, cartridge assembly 20, and charge 21.

Figure 2:
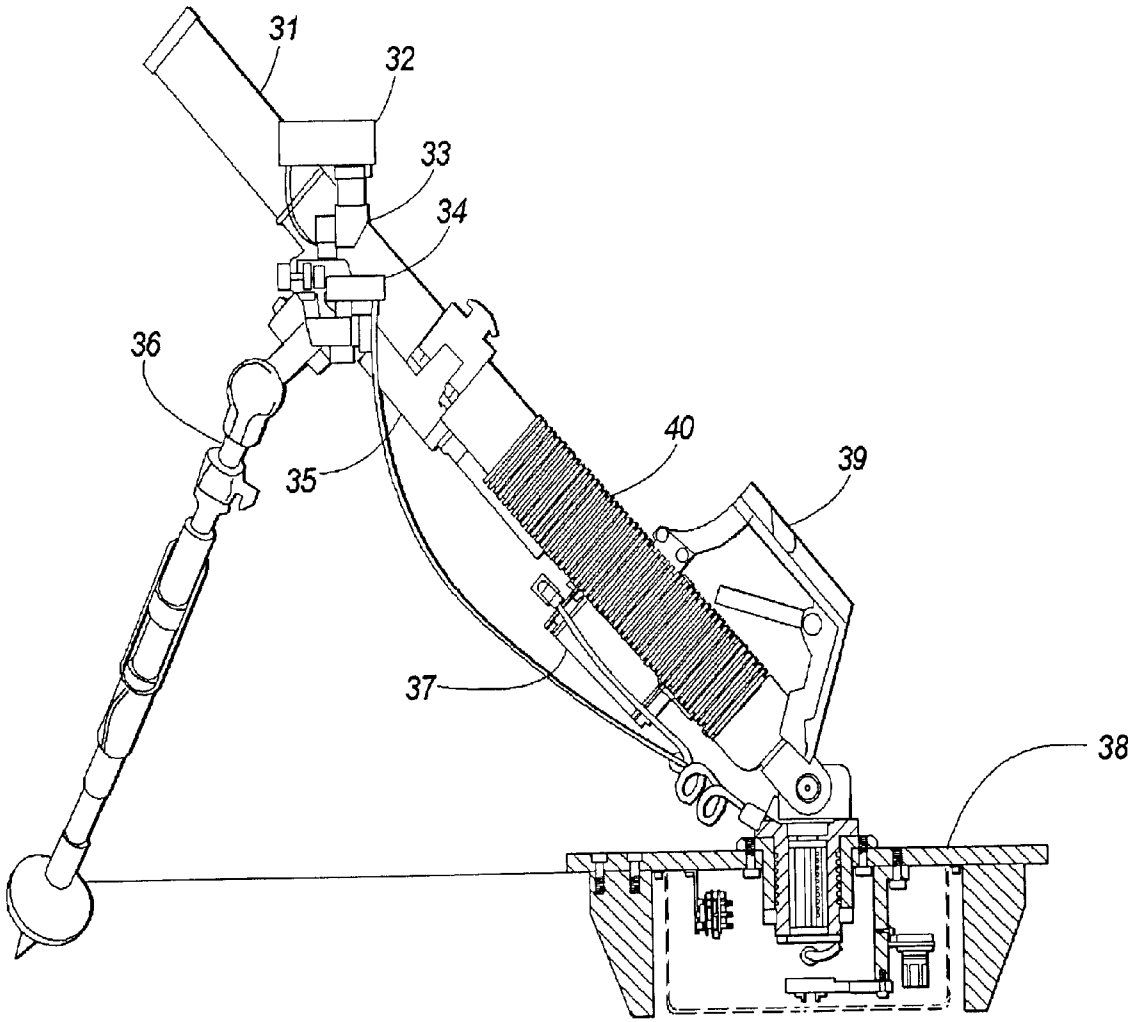
FIG. 2 is a side elevation view of a 60 mm full-size mortar training device according to one embodiment of the present invention illustrating the use of a full-size simulated cartridge assembly attached to a base assembly having portions broken away to reveal further details.

FIG. 2 is a 60 mm mortar training device consisting of barrel assembly 31, beam splitter 32, side unit 33, bubble level sensor 34, recoil assembly 35, bipod assembly 36, air cannon assembly 37, base assembly 38, handle assembly 39, cartridge assembly 40, and charge 41.

Figure 3:
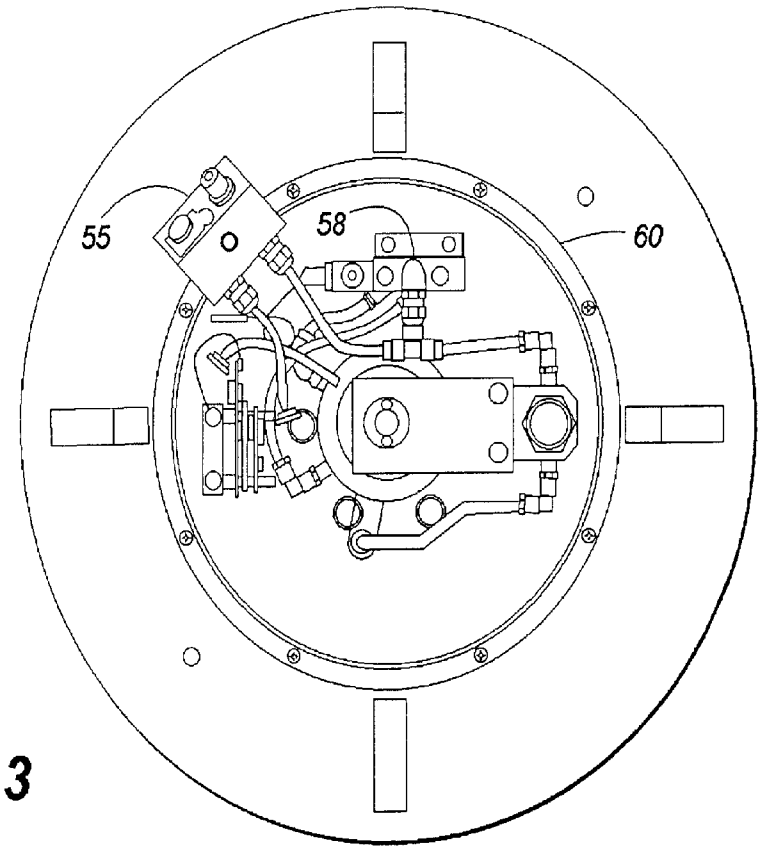
FIG. 3 is a top view of the base assembly.
Figure 4:
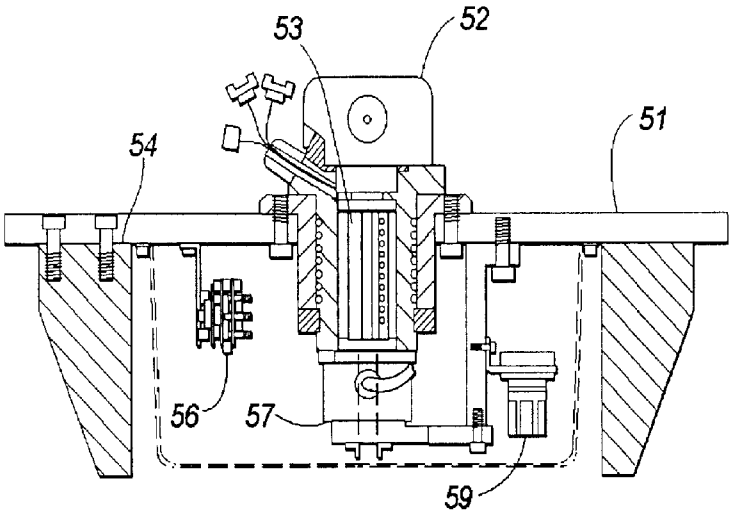
FIG. 4 is a side elevation sectional view of the base assembly.

FIGS. 3 and 4 show the base assembly 4 of both the 81 mm and the 60 mm mortar simulated training device and includes a base plate 51, a first manifold 52, a slip ring assembly 53, legs 54, second manifold 55, controller card 56, and encoder 57, valve 58, regulator 59 and cover 60.

Figure 5:
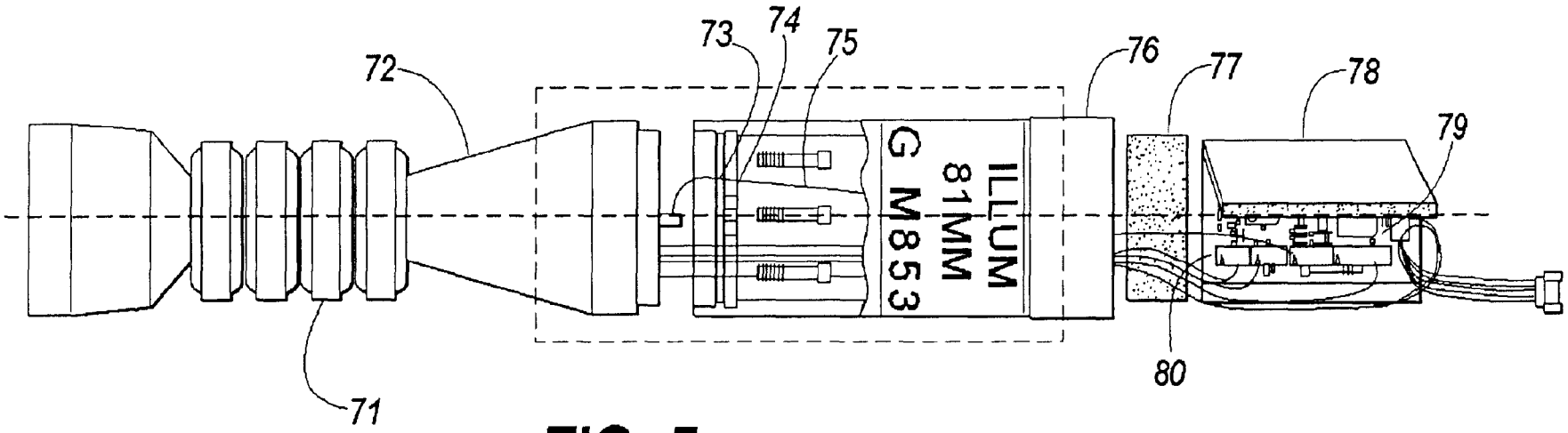
FIG. 5 is a side elevation view of one embodiment (illumination) of the simulated mortar cartridge of the present invention having portions broken away to reveal further details.
Figure 6:
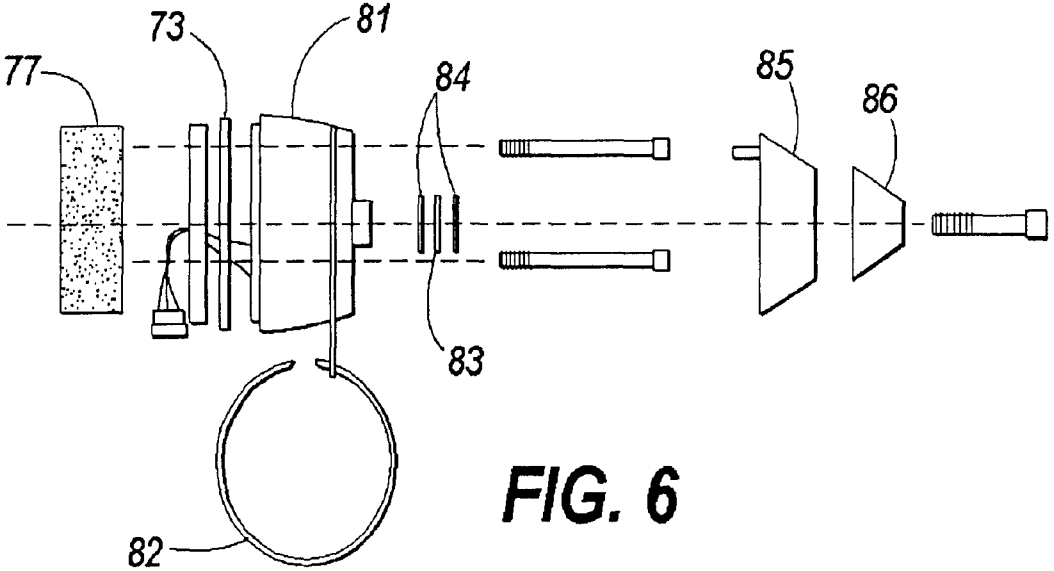
FIG. 6 is an exploded view of the nose piece of the simulated mortar cartridge shown in FIG. 5.

Referring to FIGS. 5 and 6, one embodiment (illumination) of the simulated mortar cartridge includes charge 71, tail assembly 72, spiral retaining ring 73, nut ring 74, mortar shell jumper 75, mortar tube 76, foam pad 77, anti-static foam 78, Weapons Interface Connection Card (WICC) 79, Printed Circuit Board (PCB) assembly WICC 80, nose assembly 81, safety pin 82, wave washer 83, trigger washers 84, trigger dial 85, nose cone 86. This simulated mortar cartridge is for use in an 81 mm mortar.

Figure 7:
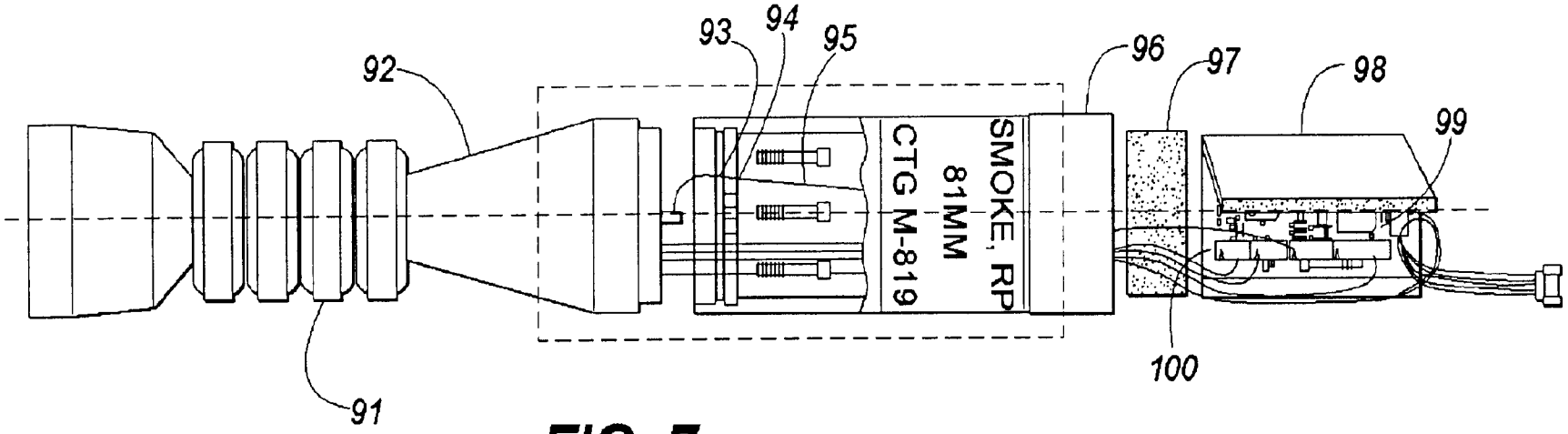
FIG. 7 is a side elevation view of one embodiment (red phosphorus-smokescreen) of the simulated mortar cartridge of the present invention having portions broken away to show further detail.
Figure 8:
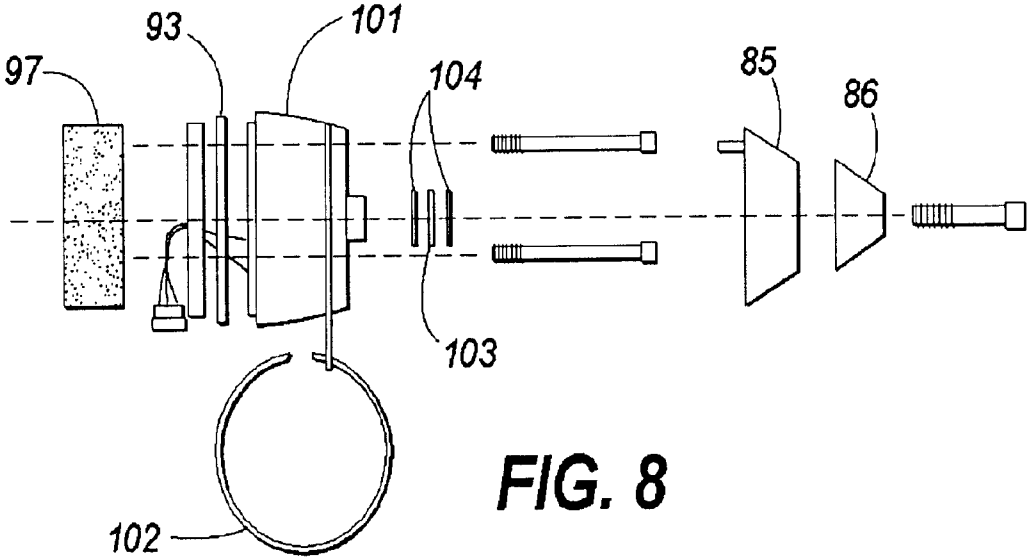
FIG. 8 is an exploded view of the nose piece of the simulated mortar cartridge shown in FIG. 7.

Referring to FIGS. 7 and 8, one embodiment (red phosphorus-smokescreen) of the simulated mortar cartridge includes charge 91, tail assembly 92, spiral retaining ring 93, nut ring 94, mortar shell jumper 95, mortar tube 96, foam pad 97, anti-static foam 98, WICC 99, PCB Assembly WICC 100, fuse nose assembly 101, safety pin 102, wave washer 103, trigger washers 104, trigger dial 105, fuse nose cone 106. This simulated mortar cartridge is for use in an 81 mm mortar.

Figure 9:
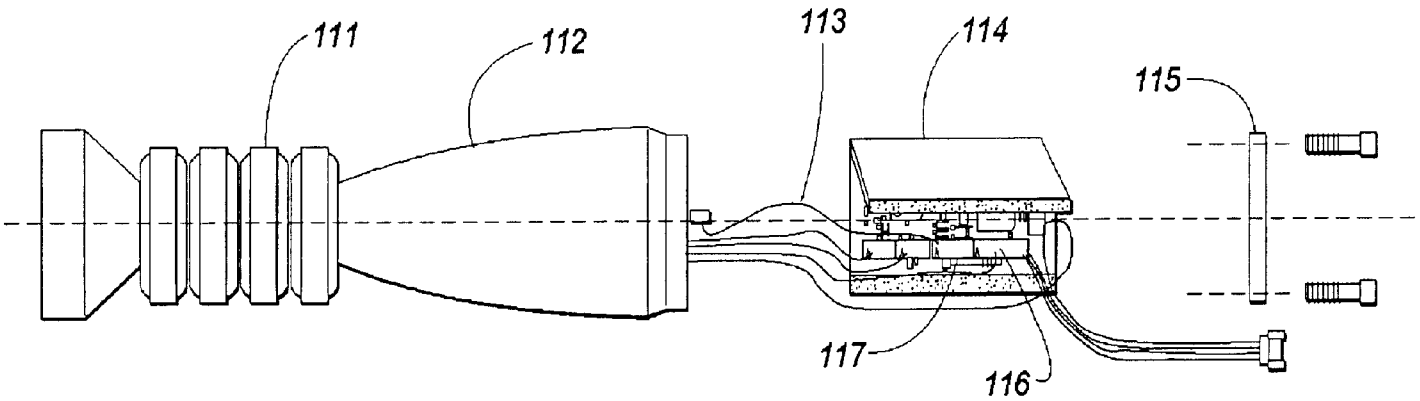
FIG. 9 is a side elevation exploded view of one embodiment (high explosive) of the simulated mortar cartridge of the present invention.
Figure 10:
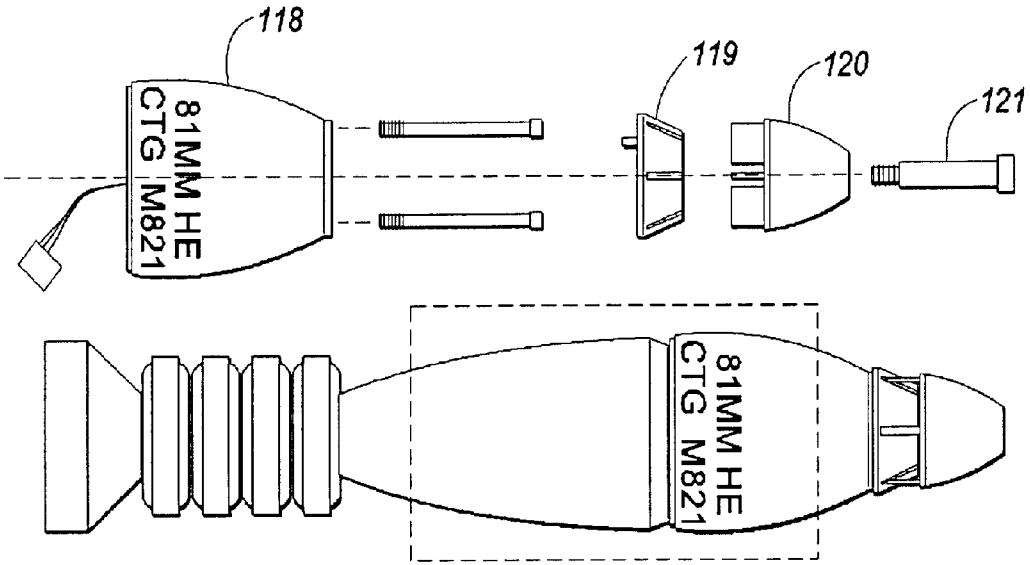
FIG. 10 is a side elevation view of the simulated mortar cartridge shown in FIG. 9.

Referring to FIGS. 9 and 10, one embodiment (high explosive) of the simulated mortar cartridge includes charge 111, tail assembly 112, mortar shell jumper 113, anti-static foam 114, crossbar 115, WICC 116, PCB Assembly WICC 117, mortar nose assembly 118, lower fuse assembly 119, upper fuse assembly 120, shoulder screw 121. This simulated mortar cartridge is for use in an 81 mm mortar.

Figure 11:
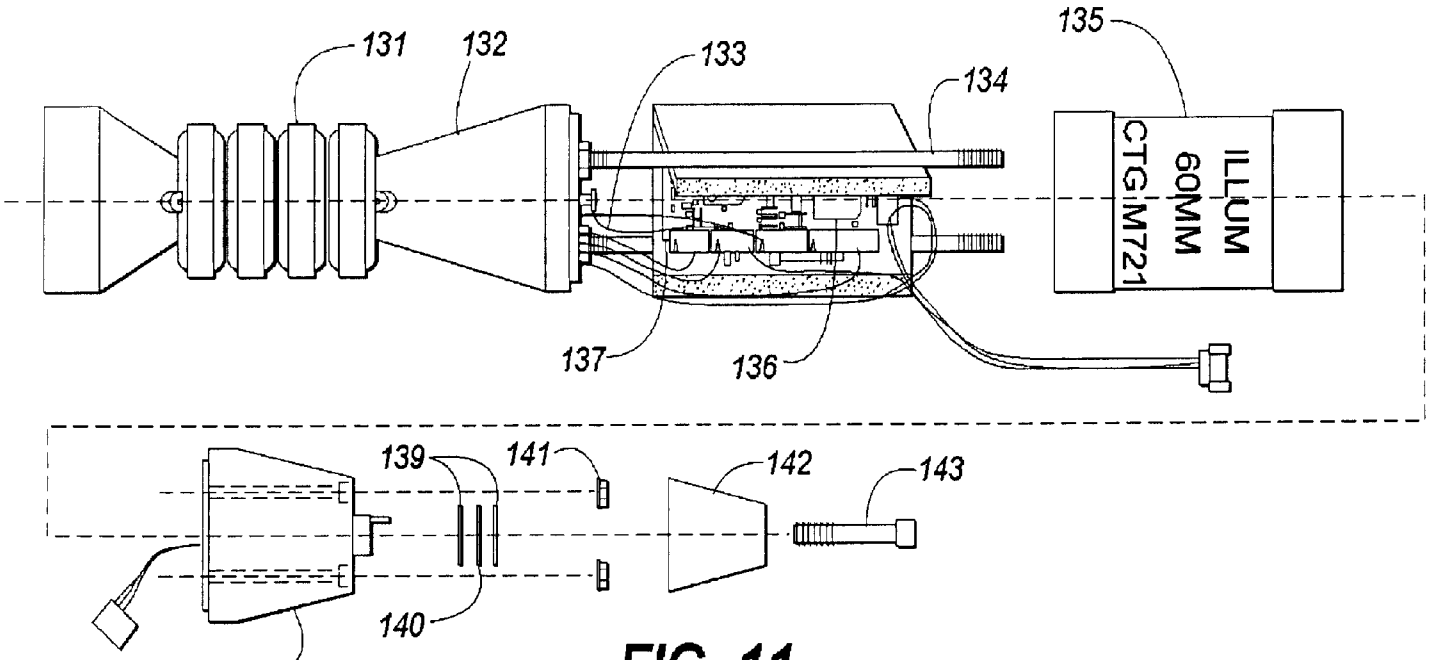
FIG. 11 is a side elevation exploded view of another embodiment (illumination) of the simulated mortar cartridge of the present invention.
Figure 12:
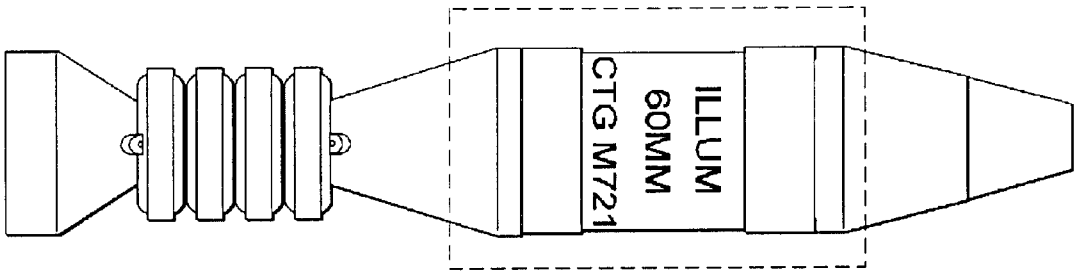
FIG. 12 is a side elevation view of the simulated mortar cartridge shown in FIG. 11.

Referring to FIGS. 11 and 12, one embodiment (illumination) of the simulated mortar cartridge includes charge 131, tail assembly 132, mortar shell jumper 133, stud 134, mortar tube 135, WICC 136, PCB Assembly WICC 137, nose assembly 138, trigger washer 139, wave washer 140, net 141, nose cone 142, screw 143. This simulated mortar cartridge is for use in a 60 mm mortar.

Figure 13:
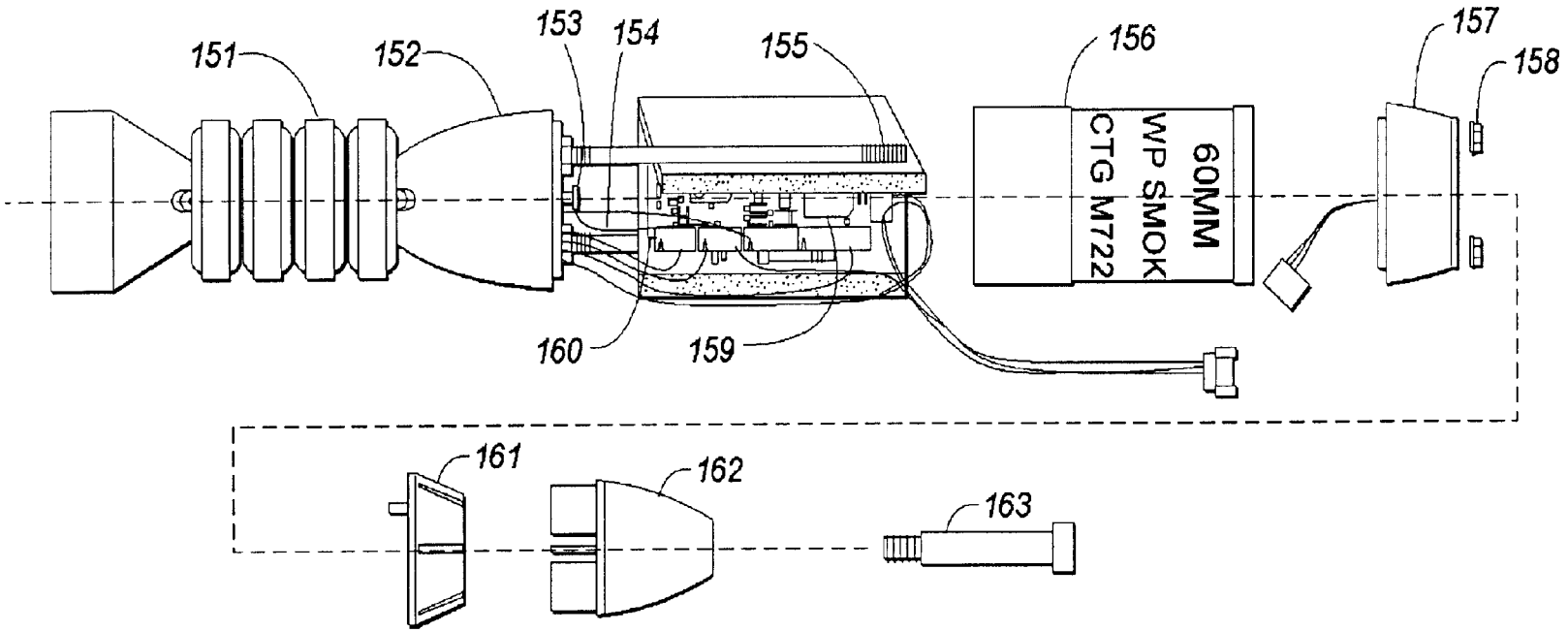
FIG. 13 is a side elevation exploded view of one embodiment (white phosphorus) of the simulated mortar cartridge of the present invention.
Figure 14:
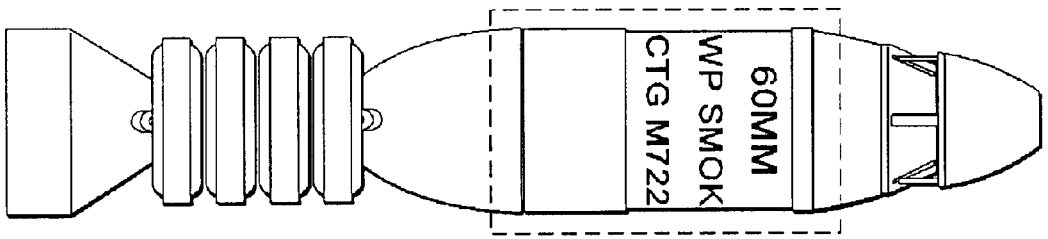
FIG. 14 is a side elevation view of the simulated mortar cartridge shown in FIG. 13.

Referring to FIGS. 13 and 14, one embodiment (white phosphorus-smoke) of the simulated mortar cartridge includes charge 151, tail assembly 152, screw 153, jumper 154, stud 155, mortar tube 156, nose assembly 157, nut 158, WICC 159, PCB Assembly WICC 160, lower fuse assembly 161, upper fuse assembly 162, shoulder screw 163. This simulated mortar cartridge is for use in a 60 mm mortar.

Figure 15:
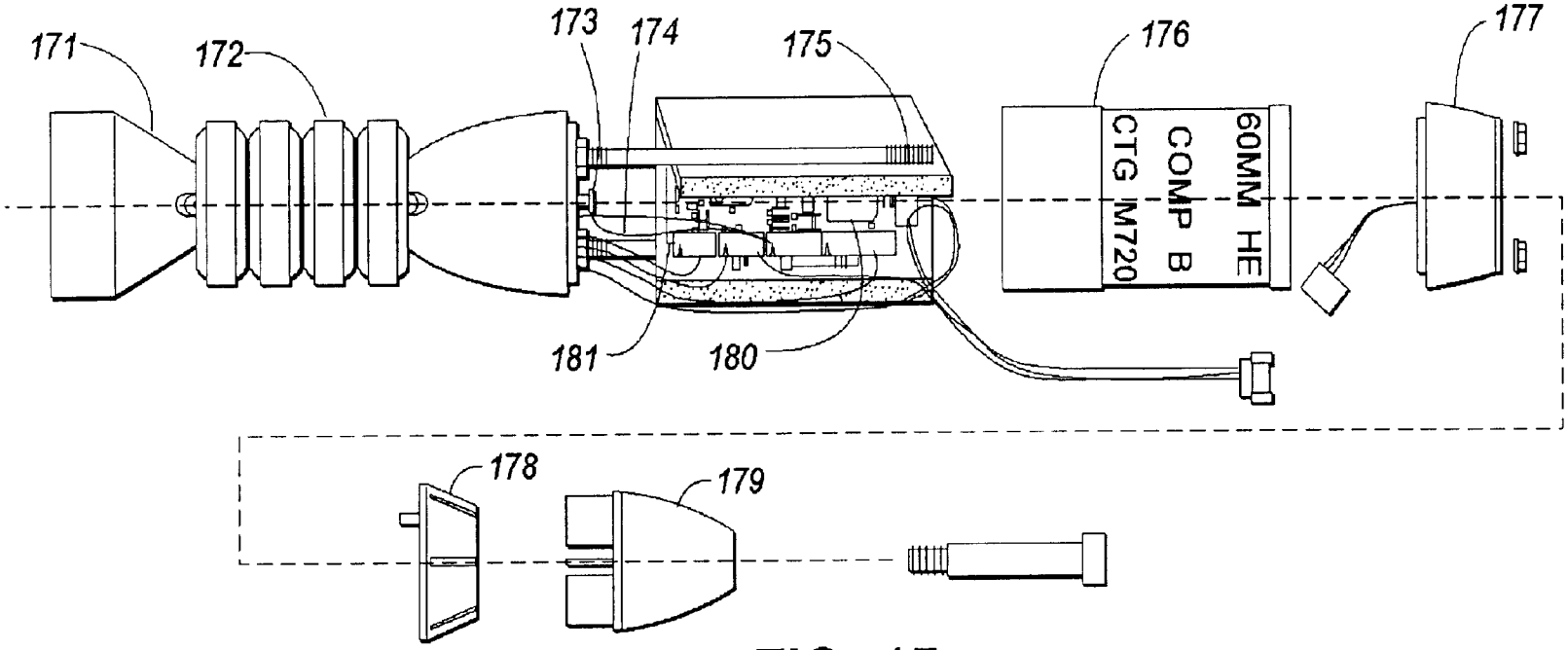
FIG. 15 is a side elevation exploded view of one embodiment (high explosive) of the simulated mortar cartridge of the present invention.
Figure 16:
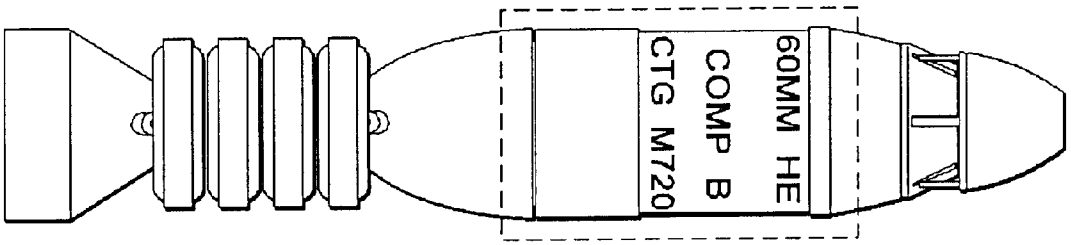
FIG. 16 is a side elevation view of the simulated mortar cartridge shown in FIG. 15.

Referring to FIGS. 15 and 16, one embodiment (high explosive) of the simulated mortar cartridge includes tail assembly 171, charge 172, screw 173, jumper 174, stud 175, tube 176, nose assembly 177, lower fuse assembly 178, upper fuse assembly 179, IC EPROM WICC 180, PCB Assembly WICC 181. This simulated mortar cartridge is for use in a 60 mm mortar.

Figure 17:
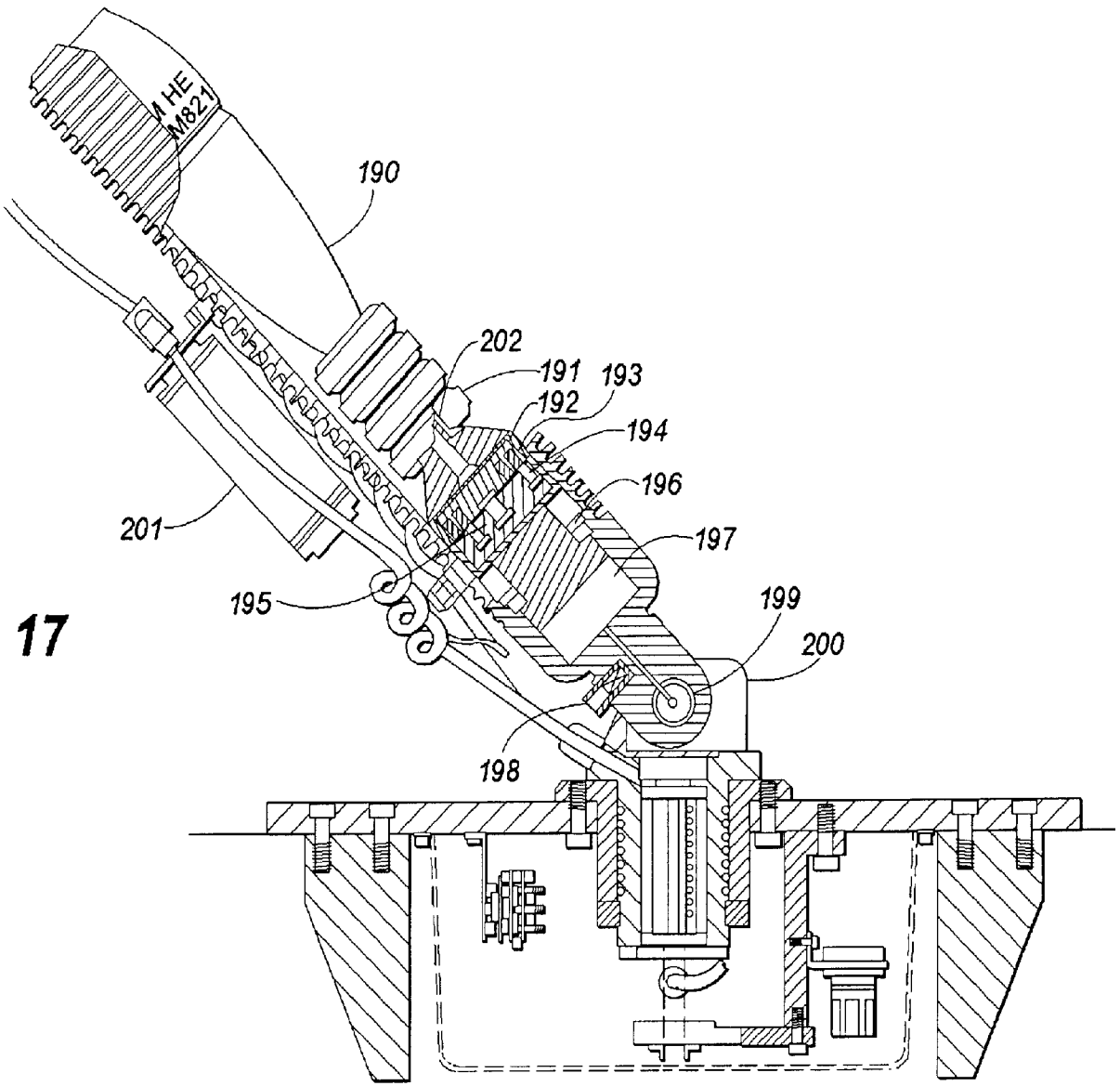
FIG. 17 is a side elevation exploded view of a portion of a mortar training device according to one embodiment of the present invention, having portions broken away to reveal further details.

Referring to FIG. 17, one embodiment of the mortar training device includes cartridge assembly 190, charge 191, ground contact 192, positive contact 193, data contact 194, data contact 195, piston/air cushion 196, air pocket 197, relief valve 198, pin assembly 199, manifold 200, air cannon assembly 201, charge sensor 202.

Figure 18:
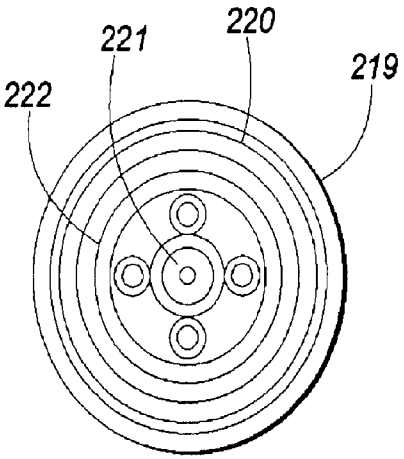
FIG. 18 is a bottom view of the simulated mortar cartridge of the present invention.
Figure 19:
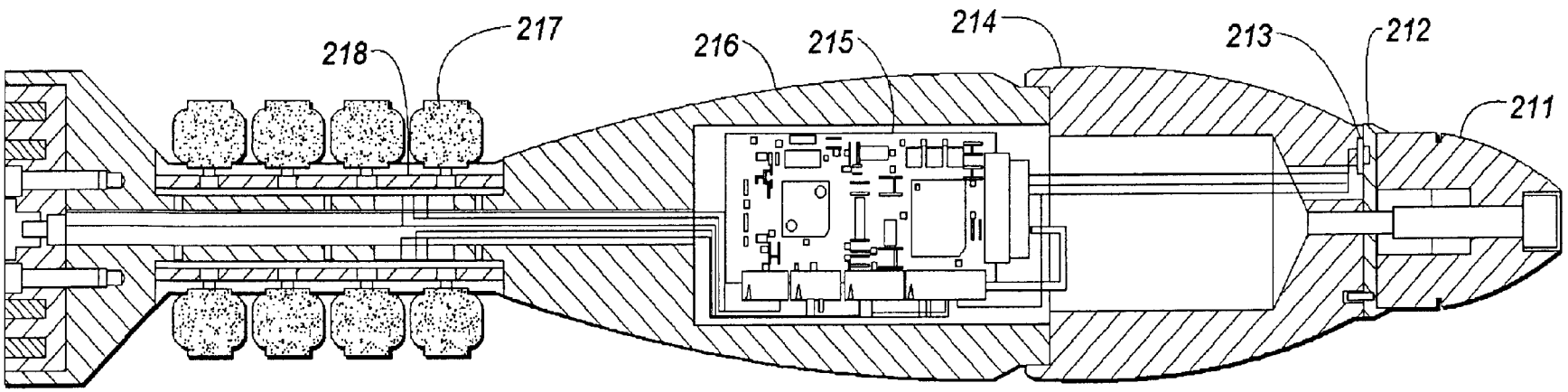
FIG. 19 is a side sectional view of one embodiment of the simulated mortar cartridge of the present invention.
Figure 20:
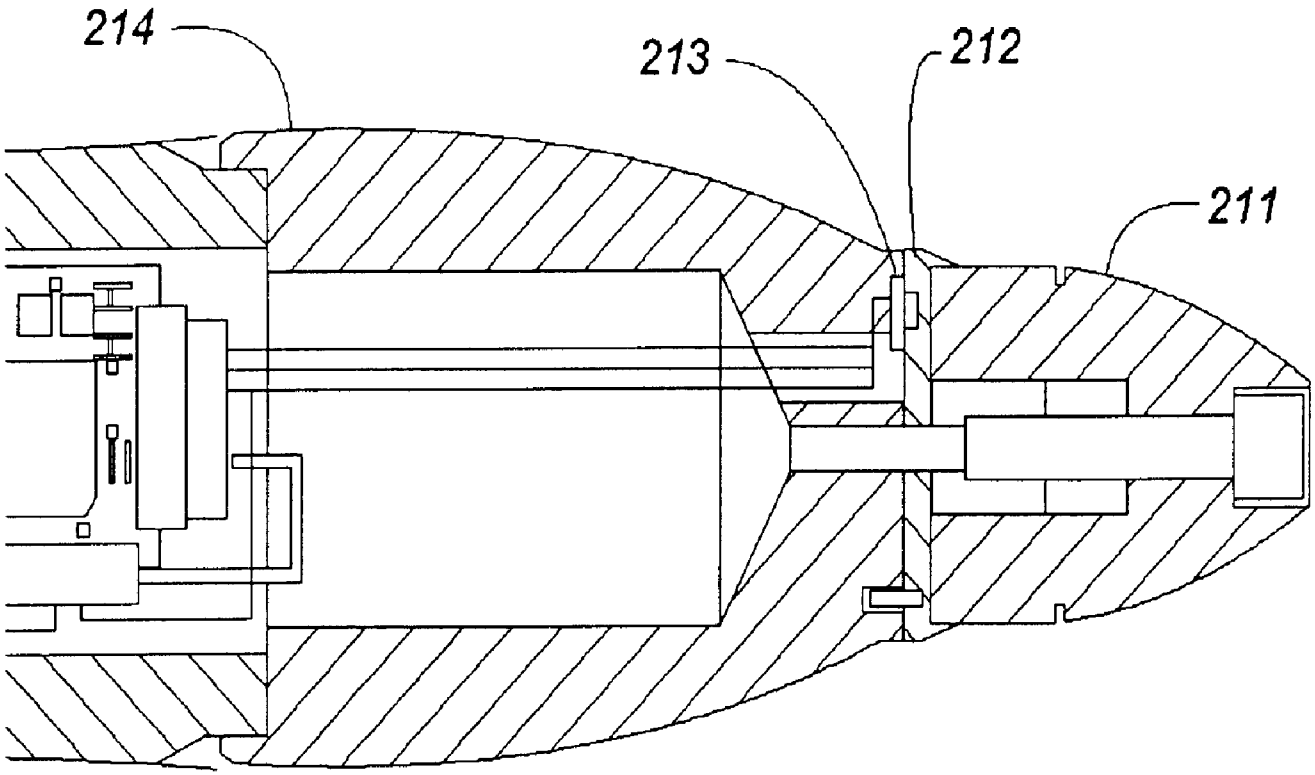
FIG. 20 is an exploded side sectional view of the nose piece of the simulated mortar cartridge shown in FIG. 19.
Figure 21:
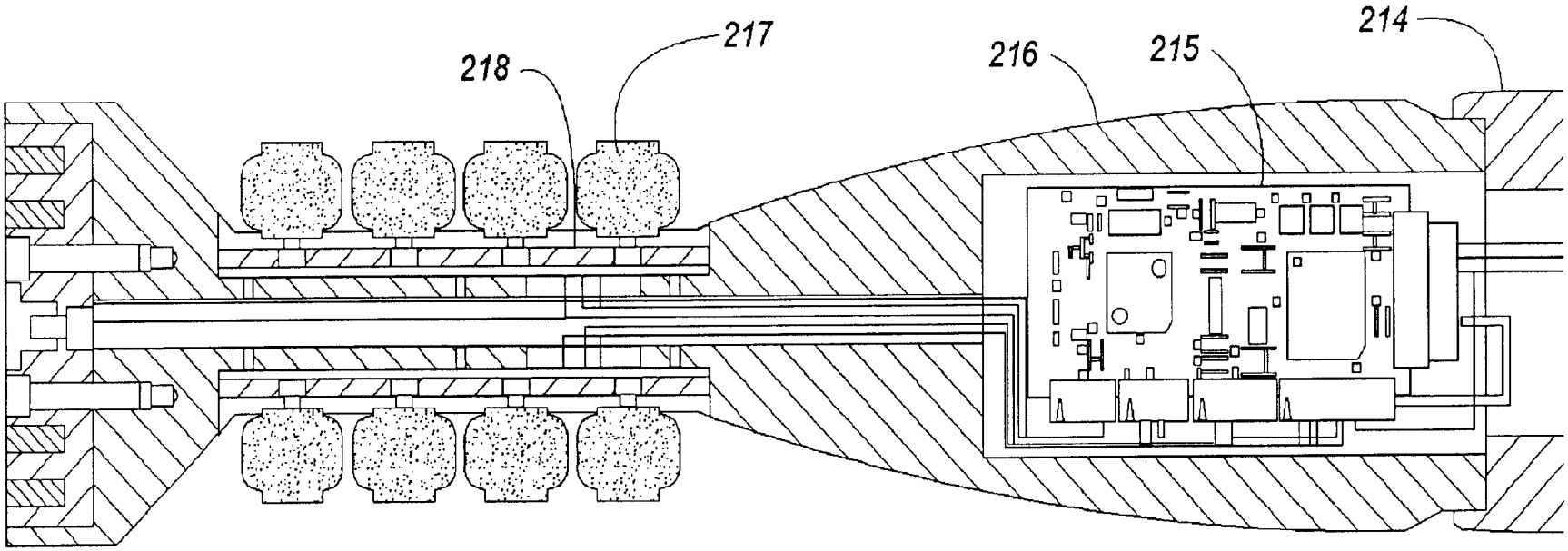
FIG. 21 is an exploded side sectional view of the body and tail assembly of the simulated mortar cartridge shown in FIG. 19.

Referring to FIGS. 18 and 19, one embodiment of the simulated mortar cartridge of the present invention includes fuse 211, adaptor 212, sensor 213, body 214, WICC 215, tail assembly 216, charge 217, optical sensor assembly 218, ground contact 219, data contact 220, postive contact 221, data contact 222.

The present invention includes a mortar training device comprising:

a base;

a barrel mounted to said base;

a simulated mortar cartridge adapted to be slidably received in said barrel to simulate a mortar firing, said cartridge having mounted therein first electronic means for inputting selected firing settings for said mortar and for generating first signals corresponding to said selected firing settings;

second electronic means in said base for determining the firing position of said barrel and for generating second signals corresponding to said firing position;

third electronic means in said base engageable with said first electronic means for receiving the first signals corresponding to said selected firing settings; and computer means connected to said second and third electronic means for calculating the fire control solution based on said first and second signals and for determining the accuracy of the fire control solution for the simulated mortar firing.

Preferably, the selected firing settings of the mortar training device of the present invention include round type, fuse setting, number of charges and primer type. Preferably, the barrel firing position of the mortar training device includes elevation angle, azimuth angle and horizontal level positions. The barrel of the mortar training device preferably has a cylindrical wall with an opening therein for removing the simulated mortar cartridge after the simulated firing. The mortar training device preferably also includes air cannon means on the barrel for generating a mortar firing sound. The mortar training device preferably also includes recoil means on the barrel for simulating recoil of the barrel. The mortar training device preferably also includes optical sighting means for determining and setting the firing position of the barrel.

The simulated mortar in the mortar training device of the present invention is fired by inserting the cartridge into the muzzle of the barrel. When released gravity and the angle of the barrel force the cartridge to slide to the base of the barrel. The cartridge is selected and set for proper function (e.g. number of charges for calculated distance, setting of fuse position to set time of explosion) prior to inserting in the barrel. The fuse portion of the cartridge assembly enables the trainee (user) to control the time of detonation, or explosion, of the projectile. In a real mortar firing, the fuse could be set to detonate on impact with the target, or before or after penetration of the target depending on the desired result. The simulated training device of the present invention also enables a user to simulate this timed detonation by adjusting the setting on the fuse. Fuse settings can be controlled by analog (e.g., a potentiometer) or digital (e.g., combination of magnets) means. The fuse contains a safety pin and, like a real fuse, will not indicate detonation if the safety is not removed prior to firing.

The cartridge advantageously contains one or more sensors that allow the detection of the number of charges placed on the cartridge at any charge placement location. As the cartridge reaches the bottom of the barrel, it comes in contact with an electronic contact pad containing one or more contacts, which is advantageously air cushioned to protect the cartridge and pad from being damaged and to prevent interruptions in the electronic communication between the cartridge and the pad. As the cartridge reaches the bottom of the barrel, its fall is cushioned by the air which is resultingly evacuated from the barrel through a relief valve in the barrel assembly. The air pressure is adjustable between zero and 110 psi and is advantageously maintained between 10 and 30 psi, preferably between 15 and 20 psi. The cartridge may, but preferably and more realistically does not, contain an independent power source because power is provided to the cartridge for the simulation functions upon contact with the electronic pad. The cartridges contain Weapon Interface Connection Cards (WICC) which record and transmit data (based on the user's settings) on the type of round, fuse setting, number of charges and type of primer in use in a particular exercise. The firing of various types of rounds may be simulated with the present invention. Such rounds include illumination rounds, which may be used to illuminate the target, red or white phosphorus rounds to provide smoke for screening and other purposes, and high explosive rounds to simulate destruction of a target. The WICC in the cartridge sends this data to the main WICC board located in the base. At the same time, the WICC board also is sent data from cards in the base. Data transmitted to the WICC board from the base includes elevation angle, azimuth angle and bubble level value. The WICC board receives all this data and sends it to the computer system which can be monitored by the user's instructor. The system takes this data and calculates the ballistics according to the ballistics table provided by the user and determines whether the simulated firing was a hit or non hit. It also is able to determine any errors made by the user as well as the type of error made, such as incorrect aim, improper cartridge configuration incorrect coordinate calculation, etc. This information can be stored in the system and replayed for later evaluation.

When the cartridge hits the bottom, not only the shell exchanges data, but the mortar recoils and the air cannon provides a simulated firing sound, so the user knows the round was fired and was not a dud. The device does allow for cartridges to be programmed as duds for realistic field simulation. Due to recoil, the user has to reacquire the target just as with a real mortar. Because the firing of the cartridge is a simulation only and the cartridge is not actually ejected from the mortar, the user must recover the cartridge from the half-open barrel in order to fire the mortar again. The mortar simulation device can be loaded and fired with the same frequency as a real mortar.

The mortar cannon of the present invention is half-open for easy removal of the cartridge. The muzzle end has a short tapered lead-in for the cartridge and, on the 81 mm device, a blast attenuator device (BAD) to muffle the sound of the firing and for ease of dropping the round. The breach end of the cannon is finned for a realistic look. The 60 mm barrel has a handle to allow for optional hand-held firing. With hand-held firing, the sight unit is not used; the user manually sets elevation and uses a manual gauge to set the azimuth. Also in the hand-held mode, the simulated cartridge does not immediately fire when dropped into the mortar barrel because the electronic pad is not set for the contact pin to engage the cartridge on contact. Instead, the user, after manually setting elevation, azimuth, and dropping the cartridge into the barrel, manually presses a firing button which will cause the contact pin to engage the cartridge and simulate firing of the mortar. No bipod is used in the hand-held mode. Consequently, the handheld mode enables a lone user to set up and fire the simulated mortar unassisted. The mortar also contains sensor means to detect which mode, hand held or bipod, is in use. The cannon also has a contact pad and an air cushion and air cannon assembly.

The mortar mount is an offset (straight for 60 mm) bipod consisting of a barrel clamp assembly which secures the bipod to the cannon barrel. Two mortar mounting buffers have been converted into recoil cylinders to provide recoil during the exercise and allow for training in target re-acquisition, a traversing gear assembly for adjusting the mortar in azimuth, an incross (bubble) leveling mechanism for correcting weapon cant, an elevating mechanism to raise and lower the cannon, and two leg assemblies to provide a stable base to the mortar of the present invention. The bubble levels are used for azimuth and elevation and are similar to a carpenter's level. They are used to determine if the sight, and thus the mortar, is in a level position, i.e., for azimuth, not tilted to either side or, for elevation, forward or rearward.

The base plate contains a knuckle assembly, an air manifold, a rotary contact assembly, an encoder for elevation, an azimuth angle value, an air regulator, and a cover.

The sight unit consists of a 1.5 power elbow telescope with a tritium-illuminated simple cross-reticle and a telescope mount with a tritium-backlighted level vial, indices, and translucent plastic scales. The telescope mount includes a 6400-mil azimuth mechanism (allowing for 360° rotation of the mortar and thus allowing for firing in any direction) with one set of coarse and fine deflection scales. A similar mechanism is provided for elevation limited to readings from 800 mils to 1600 mils on coarse and fine elevation scales. A clamp on the bubble level sensor assembly and beam splitter assembly is also included. A beam splitter (e.g. a video camera) which transfers a signal to the computer system is also attached to the sight unit to enable the instructor to view what the user sees through a monitor, to reveal whether the user acquired a proper target sight picture. Aiming posts are needed for sight acquisition for each mortar. In an emergency, any clearly defined vertical object, such as a tree trunk or corner of a building can be used as an aiming post.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A mortar training device comprising:

a base;

a barrel mounted to said base;

a simulated mortar cartridge adapted to be slidably received in said barrel to simulate a mortar firing, said cartridge having mounted therein first electronic means for inputting selected firing settings for said mortar and for generating first signals corresponding to said selected firing settings;

second electronic means in said base for determining the firing position of said barrel and for generating second signals corresponding to said firing position;

third electronic means in said base engageable with said first electronic means for receiving the first signals corresponding to said selected firing settings; and computer means connected to said second and third electronic means for calculating the fire control solution based on said first and second signals and for determining the accuracy of the fire control solution for the simulated mortar firing.

2. The mortar training device of claim 1, wherein said selected firing settings include round type, fuse setting, number of charges and primer type.

3. The mortar training device of claim 1, wherein said barrel firing position includes elevation angle, azimuth angle and horizontal level position.

4. The mortar training device of claim 1, wherein said barrel has a cylindrical wall with an opening therein for removing the simulated mortar cartridge after the simulated firing.

5. The mortar training device of claim 1, including air cannon means on said barrel for generating a mortar firing sound.

6. The mortar training device of claim 1, including recoil means on said barrel for simulating recoil of said barrel.

7. The mortar training device of claim 1 including optical sighting means for determining and setting the firing position of said barrel.

* * * * *